US006202741B1

(12) United States Patent
Demuth et al.

(10) Patent No.: US 6,202,741 B1
(45) Date of Patent: Mar. 20, 2001

(54) HEAT TRANSFER DEVICE FOR A MOTOR VEHICLE AND METHOD OF MAKING SAME

(75) Inventors: Walter Demuth, Gerlingen; Peter Hafenbrak, Bad Rappenau; Michael Kohl, Lauffen; Kurt Molt, Bietigheim-Bissingen, all of (DE)

(73) Assignee: Behr GmbH & Co., Stuttgart (DE)

( * ) Notice: Subject to any disclaimer, the term of this patent is extended or adjusted under 35 U.S.C. 154(b) by 0 days.

(21) Appl. No.: 09/197,666

(22) Filed: Nov. 23, 1998

(30) Foreign Application Priority Data

Nov. 25, 1997 (DE) ..... 197 52 139

(51) Int. Cl.[7] ..... F28D 7/06

(52) U.S. Cl. ..... 165/176; 165/148; 165/173; 29/890.03

(58) Field of Search ..... 165/176, 173, 165/153, 148; 29/890.03

(56) References Cited

U.S. PATENT DOCUMENTS

| | | | | |
|---|---|---|---|---|
| 3,746,525 | * | 7/1973 | Kasuga et al. | 165/176 |
| 5,009,262 | * | 4/1991 | Halstead et al. | 165/176 |
| 5,174,373 | * | 12/1992 | Shinmura | 165/176 |
| 5,186,244 | * | 2/1993 | Joshi | 165/140 |
| 5,318,114 | * | 6/1994 | Sasaki | 165/176 |
| 5,355,947 | | 10/1994 | Rasso, Jr. et al. . | |
| 5,603,159 | * | 2/1997 | Tsubakida et al. | 29/890.039 |
| 5,605,191 | * | 2/1997 | Eto et al. | 165/176 |
| 5,762,133 | * | 6/1998 | Dion | 165/176 |

FOREIGN PATENT DOCUMENTS

| | | |
|---|---|---|
| 3440489A1 | 5/1986 | (DE) . |
| 4432972A1 | 4/1995 | (DE) . |
| 195 15 526 C1 | 5/1996 | (DE) . |
| 196 03 016 A1 | 7/1996 | (DE) . |
| 197 19 259 | 11/1998 | (DE) . |
| 0656517A1 | 6/1995 | (EP) . |
| 0 704 666 | 4/1996 | (EP) . |
| 0704666A1 | 4/1996 | (EP) . |
| 0 757 218 | 2/1997 | (EP) . |

OTHER PUBLICATIONS

Search Report, Germany, Aug. 7, 1998.

* cited by examiner

*Primary Examiner*—Ira S. Lazarus
*Assistant Examiner*—Terrell McKinnon
(74) *Attorney, Agent, or Firm*—Evenson, McKeown, Edwards & Lenahan, P.L.L.C.

(57) ABSTRACT

A collecting box of a heat transfer device has a lengthwise partition in a collecting box between two rows of flat tubes. The tubes are designed as multichannel tubes that are divided by at least one lengthwise separating rib positioned at the level of the at least one lengthwise partition into a number of channels that corresponds to the number of collecting chambers. The at least one lengthwise partition is provided with its edge facing the tube ends with recesses with the spacing of the multichannel tubes. The recesses fit over the separating ribs of the multichannel tubes in a shapewise and flush manner and are connected tightly with the outside contours of the tube ends. In preferred embodiments the parts are made of metal and brazed together.

28 Claims, 4 Drawing Sheets

HEAT TRANSFER DEVICE FOR A MOTOR VEHICLE AND METHOD OF MAKING SAME

BACKGROUND AND SUMMARY OF THE INVENTION

This application claims the priority of German application 197 52 139.8, filed in Germany on Nov. 25, 1997, the disclosure of which is expressly incorporated by reference herein.

The invention relates to a heat-transfer device for a motor vehicle with at least one collecting box divided by at least one lengthwise partition into at least two collecting chambers extending parallel to one another, and with a rib/tube block composed of a plurality of tubes and corrugated ribs, within the tubes each forming the same number of terminating channels for both collecting chambers.

A heat-transfer device of this kind is known from German Patent Document DE 44 32 972 A1. In this document, two collecting chambers are formed by a lengthwise partition in a collecting box of the heat-transfer device. A rib/tube block of the heat-transfer device has two rows of flat tubes parallel to one another, with one row of flat tubes being associated with one collecting chamber and the other row of flat tubes being associated with the other collecting chamber of the collecting box. The tube ends of the two rows of flat tubes that terminate in the respective collecting chambers are so designed that a sufficient space remains between the adjacent tube ends of a pair of flat tubes located one behind the other in the air through-flow direction that permits the lengthwise partition to be inserted between the respective tube ends. As a result of the special design of the tube ends, a sufficient space remains for inserting the lengthwise partition in the vicinity of the collecting box, although the flat tubes abut one another directly further along the rib/tube block. The bottom through which the tube ends of the flat tubes penetrate as well as the lengthwise partition and the flat tubes themselves are made of metal and connected with one another by brazing.

A similar heat-transfer device is known from German Patent Document DE 34 40 489 A1 which has flat tubes on one side provided with a water box. The ends of the flat tubes facing away from the water box are closed. Each flat tube has a separating rib that divides the flat tube into two flow channels, said separating rib being interrupted at a distance from the respective closed end of the flat tube, thus permitting a U-shaped flow reversal of the coolant.

A goal of the invention is to provide a heat-transfer device of the species recited at the outset whose design and manufacture are further simplified relative to the prior art.

This goal is achieved by virtue of the fact that the tubes are designed as multichannel tubes divided by at least one separating rib that runs lengthwise and is positioned at the level of the at least one lengthwise partition into a number of channels that corresponds to the number of collecting chambers, and in that the at least one lengthwise partition is provided at its lower edge facing the tube ends with recesses matching the spacing of the multichannel tubes, said recesses fitting over the separating ribs of the multichannel tubes in a shapewise flush fashion and being connected tightly with the outside contours of the tube ends. With the solution according to the invention, it is merely sufficient to provide a row of tubes to produce the desired number of flow channels. By providing the lengthwise partition with the recesses that fit flush over the separating ribs, a tight connection of the at least one lengthwise partition with the multichannel tubes is created that enables reliable separation of the collecting chambers from one another. If the collecting box is provided with a bottom through which the multichannel tubes project, the lengthwise partition also has its lower edge tightly connected with this bottom. In bottomless collecting boxes, in which the multichannel tubes are expanded to a flush block, the lower edge of the at least one lengthwise partition is shaped accordingly in order to produce a tight connection with these tube ends.

In certain preferred embodiments of the invention the multichannel tubes are designed as flat tubes and the separating ribs as lengthwise beads. This is an especially simple and economical design.

In certain preferred embodiments of the invention, the at least one collecting box is provided with a bottom which in turn is provided with a number of eyelets, openings or passageways that corresponds to the number of multichannel tubes, said eyelets, openings or passageways being provided at the level of the lengthwise beads of the multichannel tubes with tab-shaped rib segments that are applied flush. The lower edge of the lengthwise partition is provided in its segments between the recesses with profiles that terminate flush with an upper surface of the bottom between the eyelets, openings or passageways. This allows a tight connection between the bottom, the multichannel tubes, and the at least one lengthwise partition.

In certain preferred embodiments of the invention, the collecting box provided with the collecting chambers, the at least one lengthwise partition, the bottom, and the tube ends that penetrate the eyelets, openings or passageways are made of metal and tightly brazed to one another. This produces a wholly metal heat-transfer device that guarantees complete recyclability. The brazing of the individual metal parts of the heat-transfer device makes possible, with especially simple means, a tight and permanent connection between the parts.

In certain preferred embodiments of the invention, the flat tubes are sealed at their ends opposite the lengthwise partition, and the lengthwise beads terminate at a distance from the sealed tube ends, forming a U-shaped reversing section. As a result, a reverse flow is produced in each flat tube that permits arranging the connections for supplying and returning a cooling or heating circuit so that a collecting box can be eliminated in the vicinity of these tube ends.

In certain preferred embodiments of the invention, the flat tubes are pressed flat in the area of the sealed tube ends and shaped in such fashion that the tube ends project to one side at right angles. As a result, by simple means, a tight closure of the tube ends is produced. Preferably, this is accomplished by simple folding or by folding combined with subsequent bending into a U.

In certain preferred embodiments of the invention, the transverse extent of the reshaped tube ends of each flat tube corresponds to the spacing of the tube ends from one another. As a result, the ends of the bent tubes in the brazed rib/tube block directly abut the respective adjacent flat tubes, so that with a corresponding braze-plating of the flat tubes, brazing of these ends to the adjacent ends of the flat tubes can be achieved that permits a stable connection of all the tube ends on the side opposite the collecting box. As a result, the stability of the entire rib/tube block and hence of the heat-transfer device is increased while at the same time making it extremely simple to manufacture.

Other objects, advantages and novel features of the present invention will become apparent from the following detailed description of the invention when considered in conjunction with the accompanying drawings.

DETAILED DESCRIPTION OF THE DRAWINGS

Figure 1:
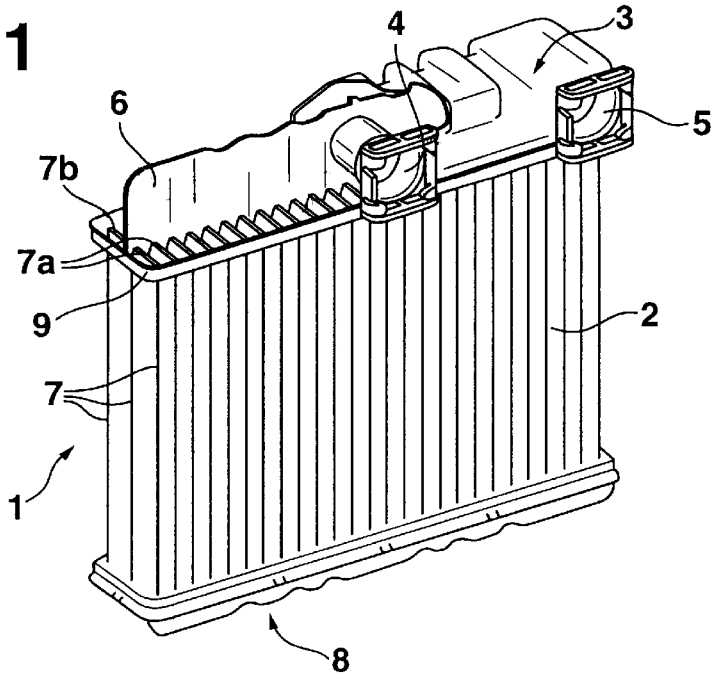
FIG. 1 is a perspective view of one embodiment of a heat-transfer device according to the invention, with the upper collecting box shown partially cut away.

A heat-transfer device 1 according to FIGS. 1 to 5 is designed as a heating body for a heating system of a motor vehicle. The heat-transfer device 1 has a rib/tube block 2 that is composed of a plurality of flat tubes 7 arranged parallel to one another in a row, as well as a corresponding number of corrugated ribs located between the flat tubes and not shown. The upper ends of flat tubes 7 terminate in a manner described in greater detail below in an upper water box also referred to as a collecting box 3. The opposite lower ends of flat tubes 7 terminate in a lower water box 8. All parts of heat-transfer device 1 are made of metal, preferably aluminum, and are brazed together in a manner known of itself in a brazing furnace.

Figure 3:
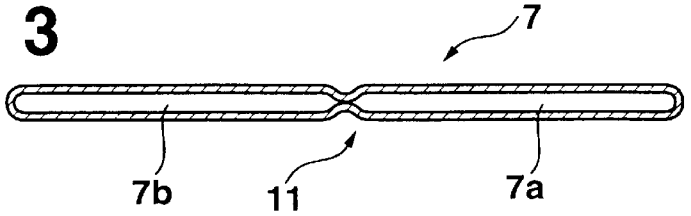
FIG. 3 is an enlarged view of a cross section through a flat tube of the rib/tube block of the heat-transfer device in FIGS. 1 and 2.
Figure 4:
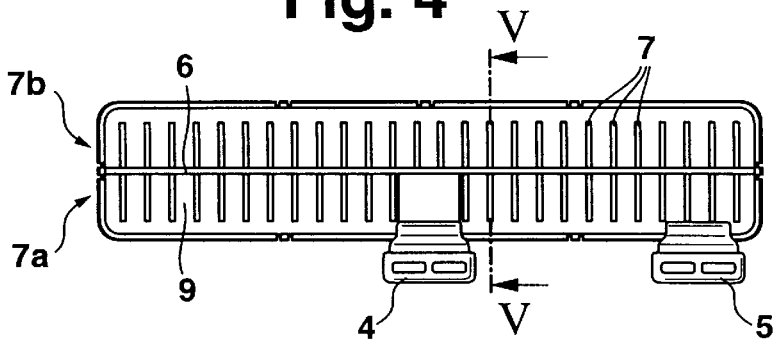
FIG. 4 is a top view of the heat-transfer device according to FIGS. 1 and 2, with the collecting box not shown.
Figure 5:
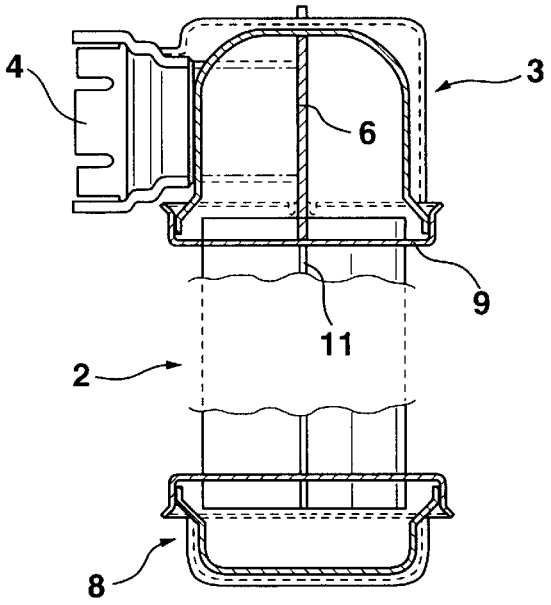
FIG. 5 is a section through the heat-transfer device according to FIG. 4 along section line V—V in FIG. 4.

Flat tubes 7 according to FIG. 3 are designed as multi-channel tubes, forming two flow channels 7*a* and 7*b*. For this purpose, at the half-width of each flat tube 7, the walls of flat tube 7 are pressed inward forming a lengthwise bead 11 over the entire length of each flat tube 7, and are tightly brazed together in this area. Lengthwise bead 11 thus forms a separating rib between the two flow channels 7*a* and 7*b*.

Figure 2:
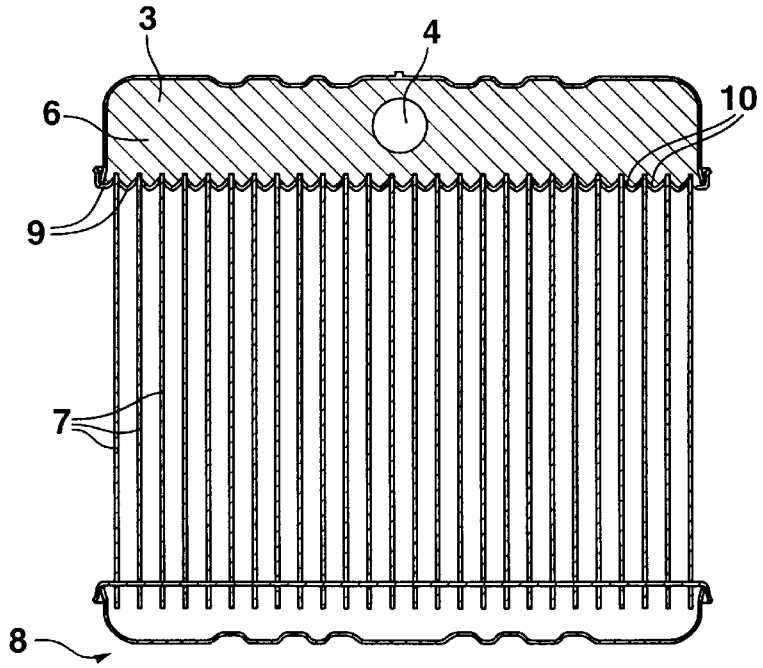
FIG. 2 is a lengthwise section at the level of a lengthwise partition of the upper collecting box through the heat-transfer device according to FIG. 1.

Lower water box 8 according to FIGS. 2 and 3 has a tub shape. Water box 8 is likewise provided with a bottom that has eyelets, openings or passageways to accept the lower ends of flat tubes 7. In the vicinity of the lower tube ends, flat tubes 7 terminate in lower water box 8, designed as a reversing box. The inlet and outlet for the coolant passing through flow channels 7*a*, 7*b*, in the present case the cooling water of a vehicle internal combustion engine, are located in upper water box 3. In order to produce a coolant circuit within rib/tube block 2, in the upper water box 3, at right angles to flat tubes 7, a lengthwise partition 6 extends over the entire length of water box 3, said partition forming two collecting chambers in upper water box 3.

Flow channels 7*a* terminate in the front collecting chamber as shown in FIG. 1, and flow channels 7*b* terminate in the rear collecting chamber. Accordingly, an inlet stub 4 terminates in the rear collecting chamber, with a connecting tube being located between the water box housing and the lengthwise partition 6. An outlet stub 5 terminates in the front collecting chamber. A requirement for a reliable flow circuit within the heat-transfer device 1 is that lengthwise partition 6 must produce a reliable and tight separation of the two collecting chambers in upper water box 3. Therefore, lengthwise partition 6 must form a seal with its lower edge against a separating rib that is tight against a bottom 9 and is also tight with respect to flat tubes 7 at the level of the ribs formed by lengthwise beads 11. Bottom 9, for a tight seal with the ends of flat tubes 7, has a number of openings 10 that matches the number of flat tubes 7 (FIG. 2), said openings being adapted to the outside contours of flat tubes 7. At the level of lengthwise beads 11, the holes have tab-shaped rib segments that fit flush in lengthwise beads 11.

Figure 9:
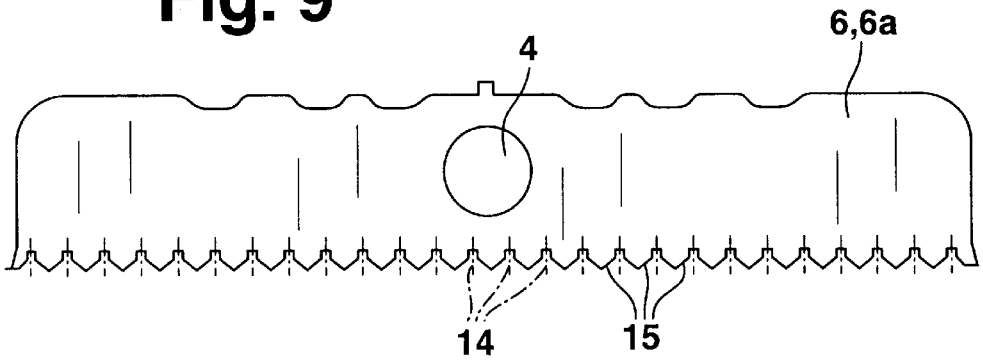
FIG. 9 is an enlarged view of the lengthwise partition for the two heat-transfer devices in FIGS. 1 and 6 as an individual part.

The tight fit of the lower edge of lengthwise partition 6, shown in FIG. 9 as an individual part, with the bottom of upper water box 3 and the ends of flat tubes 7 at the level of lengthwise beads 11 on the other hand is produced by a suitable shaping of lengthwise partition 6 to match the spacing of flat tubes 7. As is particularly evident from FIG. 9, the lower edge of lengthwise partition 6, which forms one long edge of lengthwise partition 6, has recesses 14 that have a rectangular cross section such that they each can be fitted flush onto the narrowed portions of flat tubes 7 and thus onto lengthwise beads 11. Arcuate profiles 15 are provided between recesses 14, said profiles exactly matching the surface contours of bottom 9 between the eyelets, openings or passageways for flat tubes 7. In the vicinity of its remaining surrounding outer edge, lengthwise partition 6 fits exactly into the corresponding inside contour of the housing of water box 3. Since all of the parts of heat-transfer device 1 that come in contact with one another are braze-plated, a tight brazing of the individual parts to one another is accomplished in simple fashion in the brazing furnace, especially a tight brazing of lengthwise partition 6 to bottom 9, the ends of flat tubes 7, and the housing of water box 3.

Figure 6:
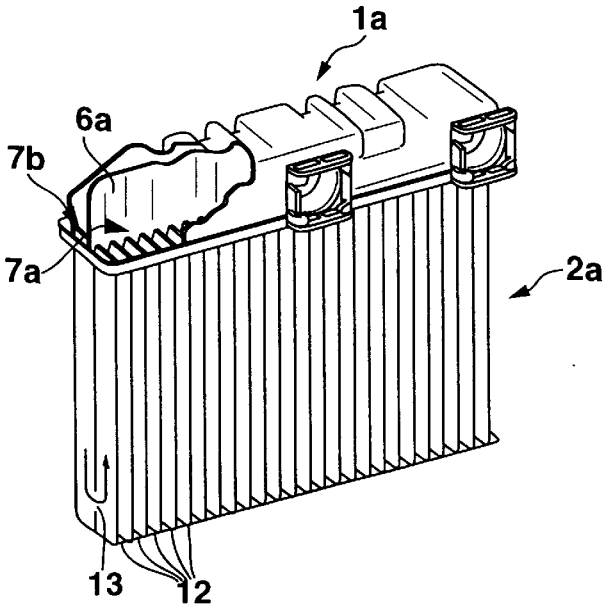
FIG. 6 is a perspective view of another embodiment of a heat-transfer device according to the invention.
Figure 7:
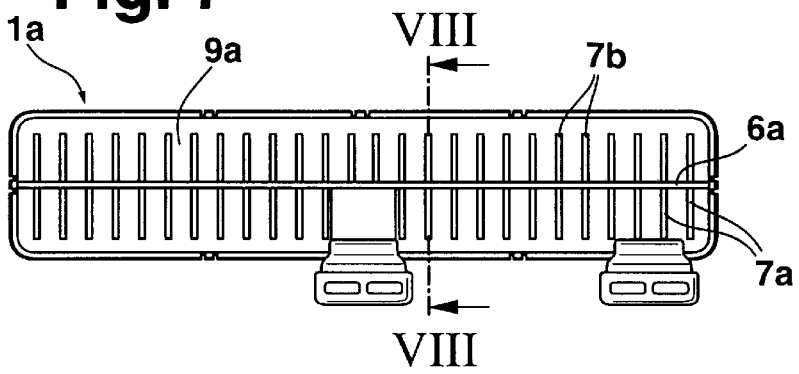
FIG. 7 is a top view of the heat-transfer device according to FIG. 6 with the collecting box removed.
Figure 8:
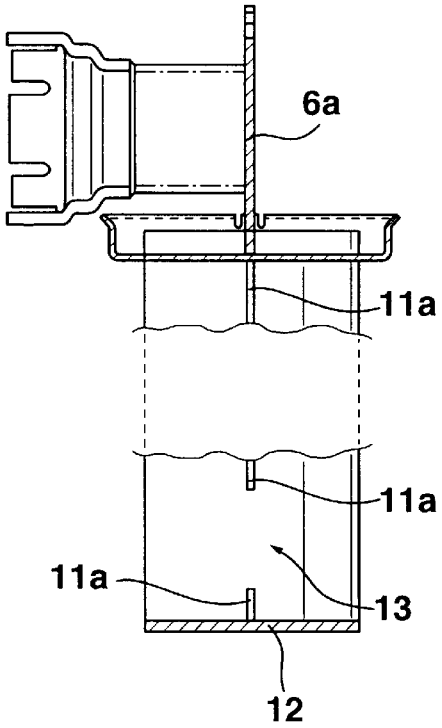
FIG. 8 is a section through the heat-transfer device shown in FIGS. 6 and 7 along section line VIII—VIII in FIG. 7.

A heat-transfer device 1*a* according to FIGS. 6 to 9 is likewise designed as a heating body for a heating system of a motor vehicle. Heat-transfer device 1*a* essentially corresponds to heat-transfer device 1, as described above. Heat-transfer device 1*a* has a rib/tube block 2*a* which is likewise provided with two-channel flat tubes, which terminate in the vicinity of an upper water box in two collecting chambers 7*a* and 7*b*. The design of heat-transfer device 1a in the vicinity of the upper water box is identical to the embodiment described above with reference to FIGS. 1 to 5. The flat tubes likewise correspond to the view in FIG. 3. The only difference from the heat-transfer device 1 in FIGS. 1 to 5 is that heat-transfer device 1a has no lower water box. Instead, the flat tubes are pressed flat and folded at right angles in the vicinity of their lower tube ends, so that a tight lower tube closure 12 results. All the flat tubes are bent in the same direction at exactly the same height, forming lower tube closures 12. The length of each folded tube closure 12 exactly matches the spacing of the flat tubes, so that the ends of tube closures 12 each fit flush against the adjacent flat tubes (FIG. 6). By suitable brazing of these ends with the adjacent flat tubes, a stable and efficient lower closure is provided for rib/tube block 2*a*.

In order to produce a reverse flow within each flat tube and thus from one flow channel into the other flow channel, the separating rib in each flat tube does not extend over the entire length of each flat tube, but is interrupted in the vicinity of the lower tube section to form an opening 13. Immediately before the transition to the folded tube closure 12, the separating rib is continued in the form of lengthwise bead 11*a* to form a reinforcing rib, so that increased stability is achieved in the transitional area between the lower tube section and the folded tube closure 12. Thus, a through flow through the flat tubes takes place according to FIG. 6 from rear flow chamber 7*b*, in which the inlet stubs of the upper water box terminate, downward and through opening 13, around the U and back again into the adjacent front collecting chamber 7*a*, from which the cooling water, cooled, flows to the outlet stub.

Figure 10:
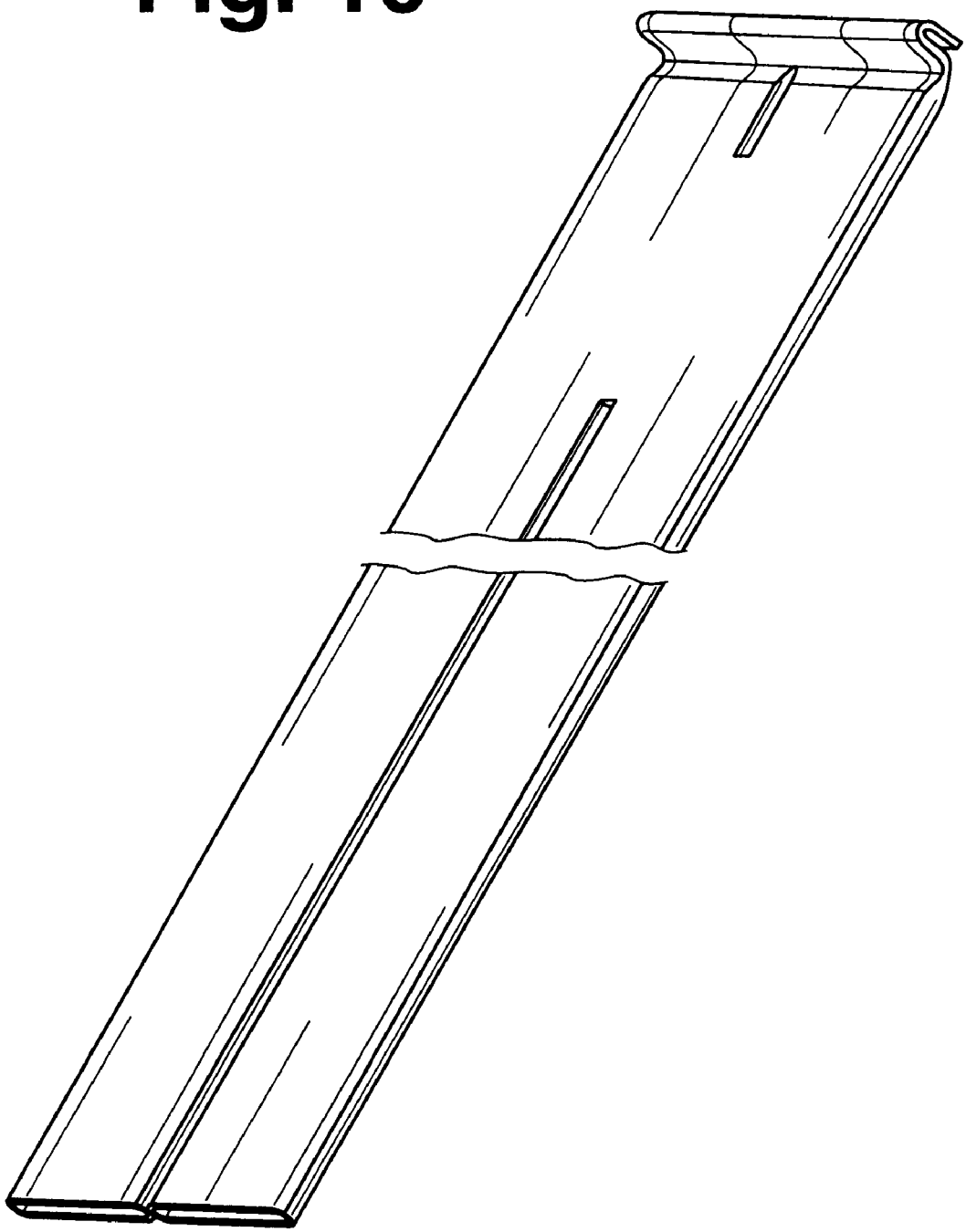
FIG. 10 shows in an enlarged perspective view an embodiment of a flat tube whose tube end is both folded and bent into a U.

In another embodiment of the invention, the sealed tube ends of the flat tubes are not simply folded at right angles, but as shown in FIG. 10, are additionally bent into the shape of a U. The transverse dimension of this tube end, as viewed from a central lengthwise plane of the flat tube, does not have to match the spacing of the flat tubes of the rib/tube block, but can even be much smaller. FIG. 10 does not have additional reference numbers provided, since the view is understandable as it stands.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Heat-transfer device for a motor vehicle comprising:

at least one collecting box divided by at least one lengthwise partition into at least two parallel collecting chambers, and a rib/tube block composed of a plurality of tubes and corrugated ribs, with the tubes for the two collecting chambers each forming the same number of terminating channels, wherein the tubes are made as multichannel tubes divided by at least one lengthwise separating rib positioned at a level of the at least one lengthwise partition into a number of channels that matches the number of collecting chambers, and wherein the at least one lengthwise partition, with its edge facing the tube ends, is provided with recesses with the spacing of the multichannel tubes, said recesses fitting over the separating ribs of the multichannel tubes in a shapewise and flush manner and being tightly connected with the outside contours of the tube ends, said partition exhibiting arcuate profiles adjoining the recesses and configured to abut corresponding arcuate profiles of the tube ends which adjoin the respective separating ribs.

2. Heat-transfer device according to claim 1, wherein the multichannel tubes are designed as flat tubes and the separating ribs are designed as lengthwise beads.

3. Heat-transfer device according to claim 2, wherein the at least one collecting box is provided with a bottom, said bottom being provided with a number of eyelets, openings or passageways that matches the number of multichannel tubes, said eyelets, openings or passageways being provided at a level of the lengthwise beads of the multichannel tubes with tab-shaped rib segments that fit flush against them, and wherein the edge of the lengthwise partition that faces the tube ends is provided in its portions between recesses with profiles that fit flush against a top of the bottom between eyelets, openings or passageways.

4. Heat-transfer device according to claim 3, wherein the collecting box provided with the collecting chambers, the at least one lengthwise partition, the bottom, and the tube ends that project through the eyelets, openings or passageways are made of metal and brazed tightly to one another.

5. Heat-transfer device according to claim 2, wherein the flat tubes are closed at their ends opposite the lengthwise partition, and wherein the lengthwise beads are interrupted in the vicinity of these tube ends, forming a U-shaped reversing section.

6. Heat-transfer device according to claim 3, wherein the flat tubes are closed at their ends opposite the lengthwise partition, and wherein the lengthwise beads are interrupted in the vicinity of these tube ends, forming a U-shaped reversing section.

7. Heat-transfer device according to claim 4, wherein the flat tubes are closed at their ends opposite the lengthwise partition, and wherein the lengthwise beads are interrupted in the vicinity of these tube ends, forming a U-shaped reversing section.

8. Heat-transfer device according to claim 5, wherein the flat tubes are pressed flat in the vicinity of the sealed tube ends and are shaped so that the tube ends project to one side at right angles.

9. Heat-transfer device according to claim 6, wherein the flat tubes are pressed flat in the vicinity of the sealed tube ends and are shaped so that the tube ends project to one side at right angles.

10. Heat-transfer device according to claim 7, wherein the flat tubes are pressed flat in the vicinity of the sealed tube ends and are shaped so that the tube ends project to one side at right angles.

11. Heat-transfer device according to claim 8, wherein the transverse extent of the shaped tube end of each flat tube corresponds to the spacing of the tube ends from one another.

12. Heat-transfer device according to claim 9, wherein the transverse extent of the shaped tube end of each flat tube corresponds to the spacing of the tube ends from one another.

13. Heat-transfer device according to claim 10, wherein the transverse extent of the shaped tube end of each flat tube corresponds to the spacing of the tube ends from one another.

14. Heat-transfer device according to claim 5, wherein the tube ends are each provided in a transitional area between the reversing section and the folded tube closure with a reinforcing rib located flush with the lengthwise bead.

15. Heat-transfer device according to claim 8, wherein the tube ends are each provided in a transitional area between the reversing section and the folded tube closure with a reinforcing rib located flush with the lengthwise bead.

16. Heat-transfer device according to claim 11, wherein the tube ends are each provided in a transitional area between the reversing section and the folded tube closure with a reinforcing rib located flush with the lengthwise bead.

17. Heat transfer device according to claim 1, wherein said separating ribs at the tube ends and said recesses of the partition fitting over the separating ribs are rectangular in shape.

18. A method of making a heat-transfer device for a motor vehicle comprising:

providing at least one collecting box divided by at least one lengthwise partition into a least two parallel collecting chambers, providing a rib/tube block composed of a plurality of tubes and corrugated ribs, with the tubes for the two collecting chambers each forming the same number of terminating channels, wherein the tubes are made as multichannel tubes divided by at least one lengthwise separating rib positioned at a level of the at least one lengthwise partition into a number of channels that matches the number of collecting chambers, and wherein the at least one lengthwise partition, with its edge facing the tube ends, is provided with recesses with the spacing of the multichannel tubes, said recesses fitting over the separating ribs of the multichannel tubes in a shapewise and flush manner and being tightly connected with the outside contours of the tube ends, said partition exhibiting arcuate profiles adjoining the recesses and configured to abut corresponding arcuate profiles of the tube ends which adjoin the respective separating ribs.

19. A method according to claim 18, wherein the multichannel tubes are designed as flat tubes and the separating ribs are designed as lengthwise beads.

20. A method according to claim 19, wherein the at least one collecting box is provided with a bottom, said bottom being provided with a number of eyelets, openings or passageways that matches the number of multichannel tubes, said eyelets, openingss or passageways being provided at a level of the lengthwise beads of the multichannel tubes with tab-shaped rib segments that fit flush against them, and wherein the edge of the lengthwise partition that faces the tube ends is provided in its portions between recesses with profiles that fit flush against a top of the bottom between eyelets, openings or passageways.

21. A method according to claim 20, wherein the collecting box provided with the collecting chambers, the at least one lengthwise partition, the bottom, and the tube ends that project through the eyelets, openings or passageways are made of metal and brazed tightly to one another.

22. A method according to claim 19, wherein the flat tubes are closed at their ends opposite the lengthwise partition, and wherein the lengthwise beads are interrupted in the vicinity of these tube ends, forming a U-shaped reversing section.

23. A method according to claim 20, wherein the flat tubes are closed at their ends opposite the lengthwise partition, and wherein the lengthwise beads are interrupted in the vicinity of these tube ends, forming a U-shaped reversing section.

24. A method according to claim 22, wherein the flat tubes are pressed flat in the vicinity of the sealed tube ends and are shaped so that the tube ends project to one side at right angles.

25. A method according to claim 24, wherein the transverse extent of the reshaped tube end of each flat tube corresponds to the spacing of the tube ends from one another.

26. A method according to claim 24, wherein the tube ends are each provided in a transitional area between the reversing section and the folded tube closure with a reinforcing rib located flush with the lengthwise bead.

27. A method according to claim 25, wherein the tube ends are each provided in a transitional area between the reversing section and the folded tube closure with a reinforcing rib located flush with the lengthwise bead.

28. A method according to claim 18, wherein said separating ribs at the tube ends and said recesses of the partition fitting over the separating ribs are rectangular in shape.

* * * * *